United States Patent [19]

Christensen

[11] Patent Number: 4,794,711

[45] Date of Patent: Jan. 3, 1989

[54] PERPETUAL ENGAGEMENT CALENDER AND WALLET

[76] Inventor: Richard A. Christensen, 828 Spring St. NE., Minneapolis, Minn. 55413

[21] Appl. No.: 117,301

[22] Filed: Nov. 6, 1987

[51] Int. Cl.[4] ..... G09D 3/02

[52] U.S. Cl. ..... 40/122

[58] Field of Search ..... 40/107, 122, 124.2, 40/405; 283/2, 3; 150/135, 147

[56] References Cited

U.S. PATENT DOCUMENTS

| | | | |
|---|---|---|---|
| 339,173 | 4/1886 | Heaton | 40/124.2 |
| 384,526 | 6/1888 | Isbell | 40/107 |
| 673,025 | 4/1901 | Leach | 40/122 |
| 811,846 | 2/1906 | Hidden | 40/107 |
| 2,909,202 | 10/1959 | Rock | 150/139 |
| 3,207,421 | 9/1965 | Hunger et al. | 229/72 |
| 3,267,980 | 8/1966 | Bird | 150/135 |
| 3,777,795 | 12/1973 | Graetz | 150/147 |
| 3,911,606 | 10/1975 | Hunkins | 40/110 |
| 3,983,649 | 10/1976 | Ellis et al. | 40/122 |
| 4,218,077 | 8/1980 | Ember | 283/2 |
| 4,319,771 | 3/1982 | Yglesias | 283/2 |
| 4,451,067 | 5/1984 | Williams | 281/31 |
| 4,575,126 | 3/1986 | Grubbs | 283/38 |
| 4,669,754 | 6/1987 | Lalonde | 283/67 |

FOREIGN PATENT DOCUMENTS 2124413 2/1984 United Kingdom ..... 40/107

*Primary Examiner*—Gene Mancene
*Assistant Examiner*—Cary E. Stone
*Attorney, Agent, or Firm*—Kinney & Lange

[57] ABSTRACT

A perpetual engagement calendar and wallet includes a daily calendar panel having a numbered day pocket for each day in the longest month. Cards indicating all twelve months are provided and at the beginning of each month, a card indicating the name of that month is associated with the day pocket numbered one and all of the other days of that month. As the days pass, this month card is moved down daily to the current day, and the card bearing the name of the next month is positioned adjacent the day pocket numbered one. As engagements are made, memo cards are filled out indicating the day and month of the engagement together with any other information regarding the engagement, and each card is placed in the day pocket associated with that month and that day in such a position that the user can see at a glance the engagements committed to. Cards identifying the days of the month which fall on Sunday are positioned within the appropriately dated pockets so that the user can see at a glance which days of the week are work days and which are weekends.

14 Claims, 4 Drawing Sheets

NAME
ADDRESS
ADDRESS
TELEPHONE
Haircut 10:30 am
Conference Sep. 27 2pm
Dentist 3PM.
SEPTEMBER
OCTOBER
NOVEMBER
DECEMBER
AUGUST
JULY
JUN
MAY
APR
MAR
FEB
JAN
SEP
DEC
AUG
NOV
JUL
OCT
1987
1988

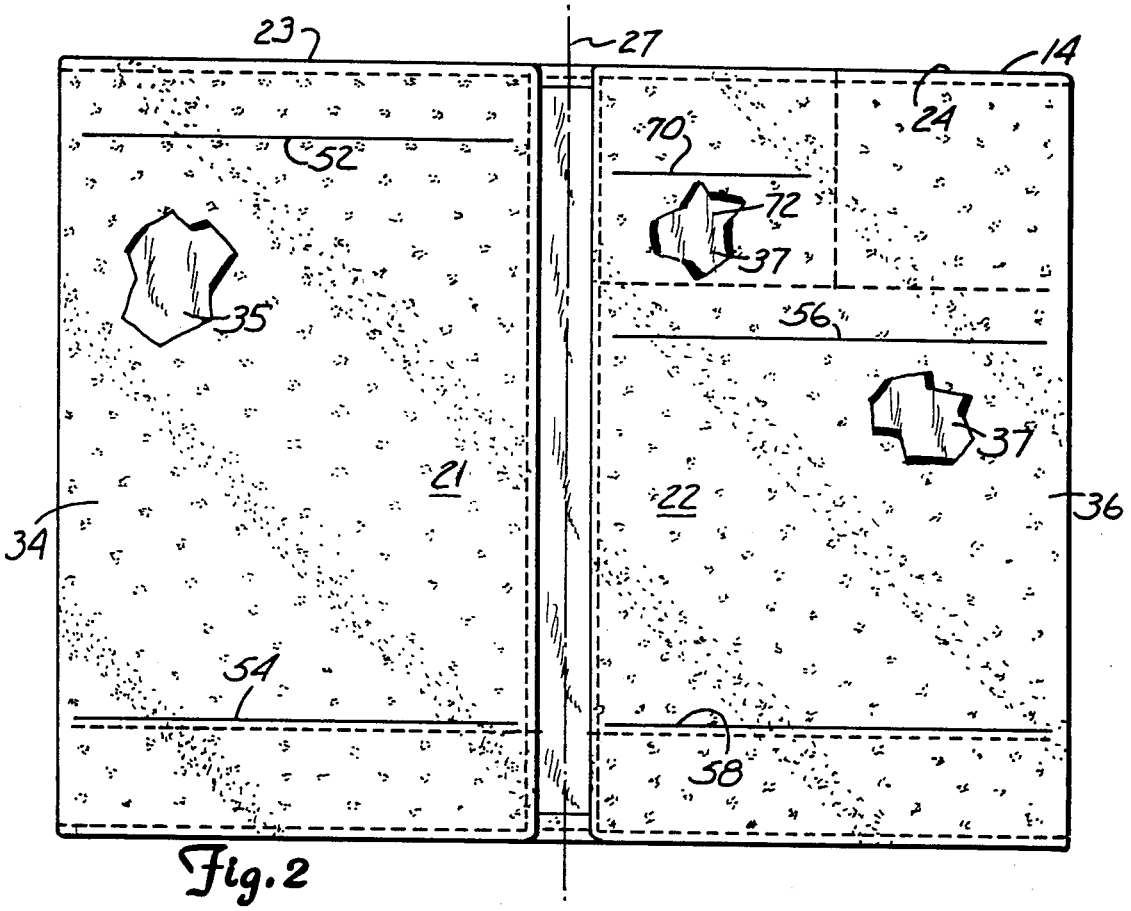
Fig. 2
Fig. 8
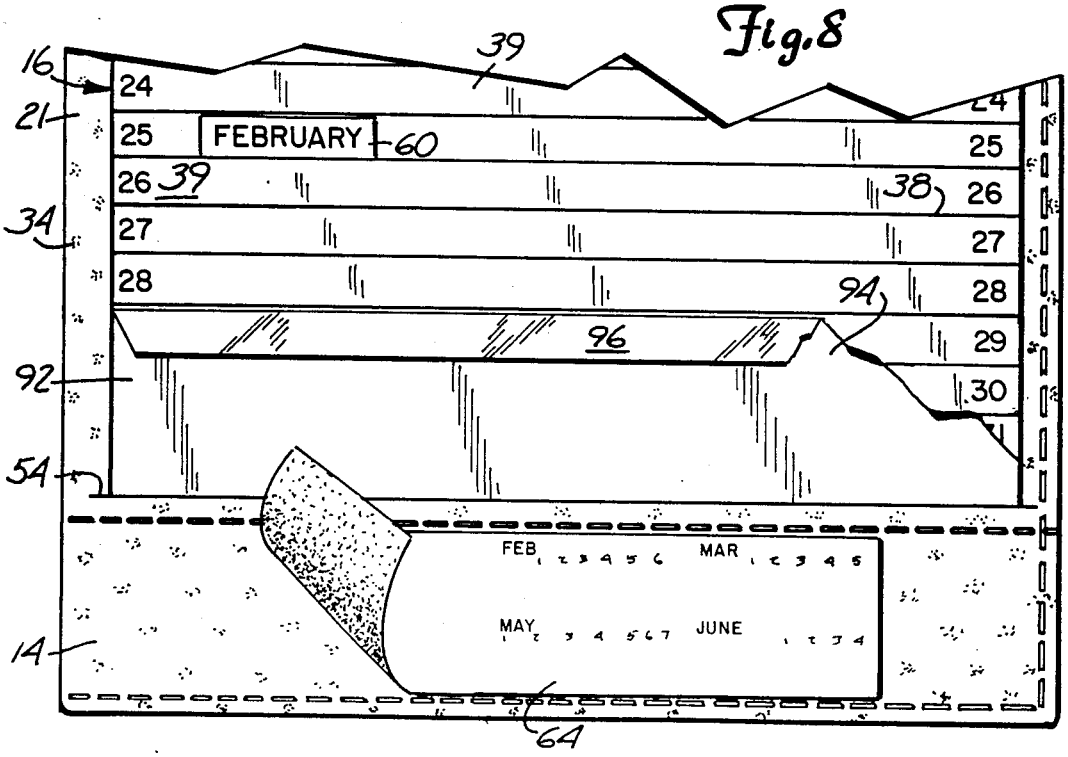

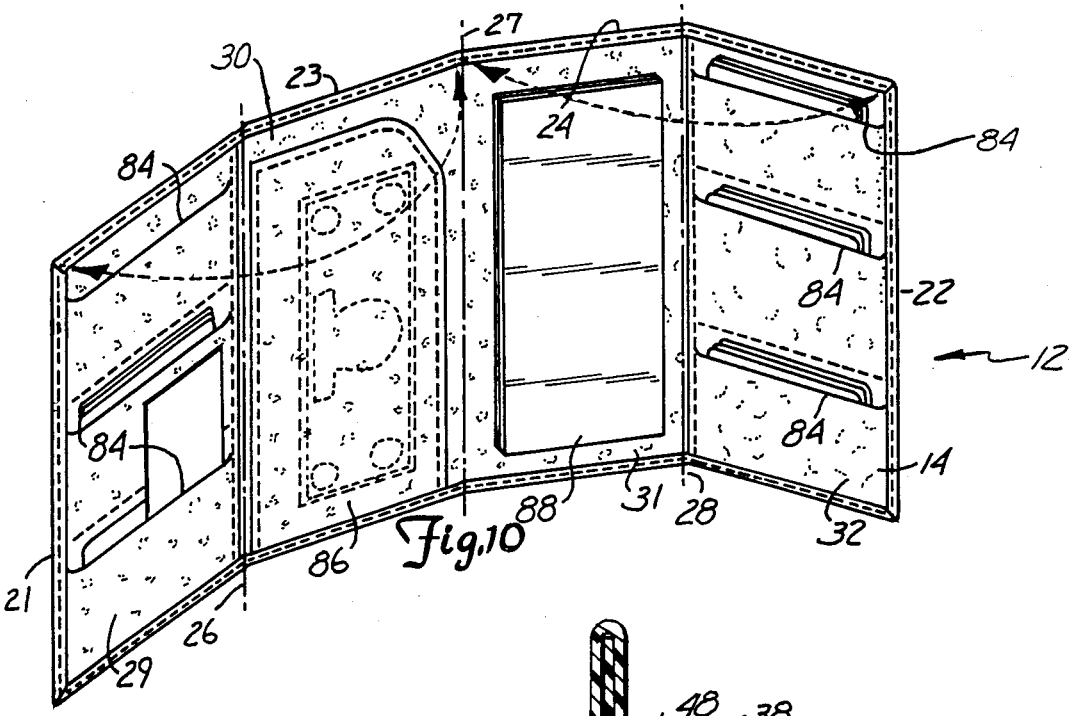
Fig.10
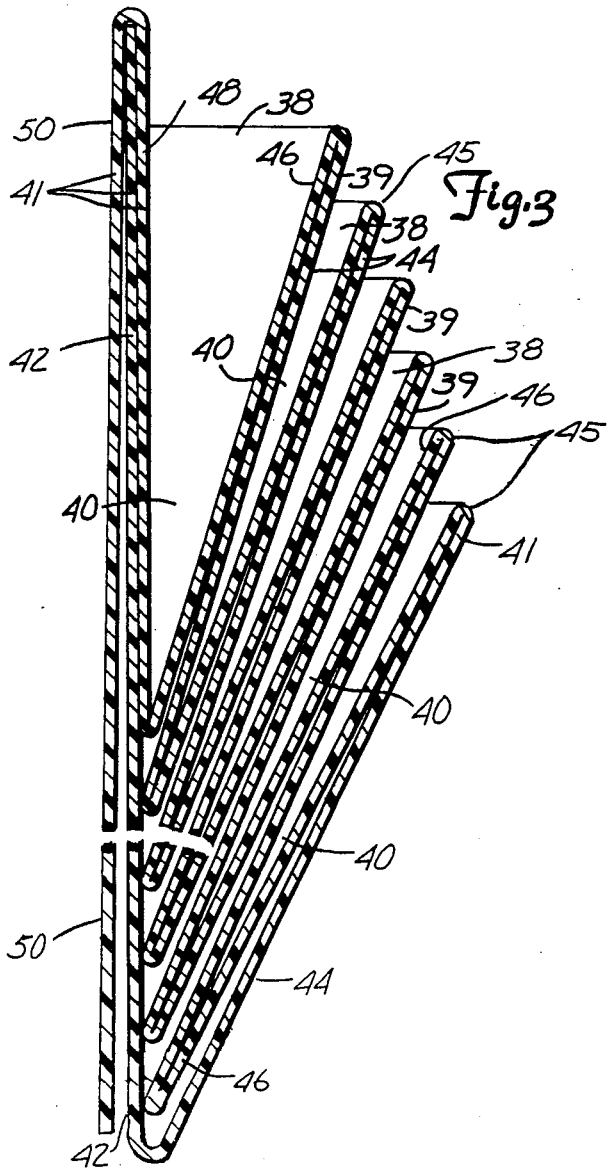
Fig.3
Fig. 6
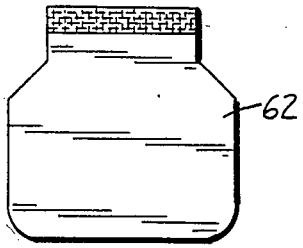
Fig.7
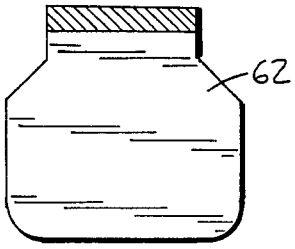

PERPETUAL ENGAGEMENT CALENDER AND WALLET

BACKGROUND OF THE INVENTION

1. Field of the Invention

This invention has relation to a perpetual engagement calendar for use with a calendar system which divides years into months, months into days and weeks into days; and has relation to a wallet which is useable with such a calendar. The invention is readily adaptable to use with other calendar systems.

2. Description of the Prior Art

It is known to use desk calendars which employ a separate page for each day in a year. Other calendars also consist of many pages. In some, an entire month is shown on one page, in others, an entire week is shown at a glance on two adjacent pages; and in still others, a single sheet is used to show every month, week and day of an entire year. To use any of these calendars to record engagements made in advance, it is customary to write up the engagement on the proper calendar page adjacent the indicated day space on that page and then, after the engagement is kept, to simply disregard that written notation. This means that at the end of the time period covered by the calendar, an entirely new calendar must be obtained.

In a preliminary patentability search on the invention set out herein, the following U.S. patents were noted: U.S. Pat. Nos. 384,526 granted to Isbell in June of 1808; 673,025 granted to Leach in April of 1901; 2,909,202 granted to Rock in October of 1959; 3,207,421 granted to Hunger et al. in September of 1965; 3,267,980 granted to Bird in August of 1966; 3,777,795 granted to Graetz in December of 1973; 3,983,649 granted to Ellis et al. in October of 1976; 4,218,077 granted to Ember in August of 1980; 4,319,771 granted to Yglesias in March of 1982; 4,451,067 granted to Williams in May of 1984; 4,575,126 granted to Grubbs in March of 1986; and 4,669,754 granted to Lalonde in June of 1987.

The patent to Hunger et al. shows a reminder device where flexible transparent pockets are provided over the various days of the month and notes or pills or anything else related to that date of the month are inserted in the pockets.

The patent to Rock shows a blank calendar sheet 10 which can be made into a calendar for any month by writing the days of the month onto the calendar sheet. Once that month is over, the sheet is expendable, and a new sheet must be marked up for the next month.

The patent to Leach uses thirty-one different index file cards, each labeled for one day of the month, with a file card for each of the months of the year. The days of the week are rotatable on an endless display supported at the top of the file cards so that each day of the week can be aligned with a particular day of a particular month. Notes representing things to be done in a particular day can be kept in front of or behind a card representing a day of the month. When a day passes, the notes can be discarded, and that day card put behind the label for the month and in front of the label for the next month.

The patent to Isbell shows a mechanical three-dimensional calendar which can be changed monthly to conform to any particular month. At the end of that month, it can be changed to conform to the next month. Various appointments can be written on small cards and placed in data pockets.

The patent to Lalonde shows a book/calendar system whereby separate pages are provided for each day of the month. A plurality of blank or pre-printed sheets are provided to be temporarily put on each page. A separate sheet must be used for each month.

Workbooks with pluralities of pockets for organizational purposes are shown in the patents to Grubbs and Williams.

The patent to Yglesias presents a programmable calendar wherein a single hole is punched through a series of aligned cards to indicate the day of the week which is to be associated with each day in a month.

The patents to Ellis and to Graetz disclose pocket structures into which notes regarding future activities can be placed. In the Ellis patent, seven pockets are provided so that all of the engagements scheduled for the first of the fourth day in May, for example, can be put in one pocket, all of the engagements from the fifth through the ninth in another pocket, tenth through fifteenth in another, and so forth. In the Graetz patent, multiple pockets are provided for storing notes or any other kind of information in a wallet.

The patent to Ember shows an appointment reminder system, and the patent to Bird discloses a multicompartment book and billfold combination. Neither is believed to be particular pertinent to the present invention.

Neither the inventor nor those in privity with him are aware of any prior art or combination of prior art which anticipates the present invention nor any of the claims presented herein.

SUMMARY OF THE INVENTION

A perpetual engagement calendar and wallet is for use with a calendar system which divides years into months, months into days and weeks into days. This calendar/wallet includes a daily calendar panel including a day pocket for at least one day in the longest month, one such day pocket being visually associated with each day within a month by the presence of indicia adjacent the day pockets. A plurality of memo cards are provided, each of configuration to fit within any day pocket. These memo cards are adapated to receive and retain information identifying an engagement schedule for a particular day in a particular month. A plurality of month-indicating cards are provided, each carrying indicia indentifying a particular month, each such month card being of configuration to fit within a day pocket so as to display the month identifying indicia. A plurality of week-identifying cards are provided, each carrying indicia for visually distinguishing a particular day of the week in one month from the same day of the week in an immediately preceding or succeeding month, each such week card being of configuration to fit within any day pocket so as to display its indicia. In the form of the invention as shown, these week cards identify particular Sundays of a month in such a manner as to distinguish them from the Sundays of previous and following months.

The method of keeping track of future, present and past engagements according to the present invention includes the steps of: Providing the day receptacles as set out above; at the beginning of each month associating with the day receptacle associated with the first day of the current month, a card indicating that month; moving said month indicating card down to the appropriate day receptacle as each day passes to associate that current month with each of the remaining days of that month; by at least the second day of each month, associating a month-indicating card carrying the name of the next month with the day receptacle identified with the first day of the month to thereby associate the name of the next coming month with the first day and all of the following days of that coming month up to the then current day of the current month; entering on a separate memo card the date including the month and day and any other desired information as to an engagement to be fulfilled and placing that memo card in the day receptacle associated with that day of that month after the receptacle has become associated with that particular month and day; and after the day and month of the engagement have passed, removing said memo card from said day receptacle for storage or discard.

The method also includes providing advance receptacle storage means of configuration to receive and store memo cards dated prior to the availability of a day receptacle associated with that date, and storing in this advance receptacle storage means each dated memo card until such time as the date of the engagement becomes available on the daily calendar panel.

Further, the method includes the step of providing a historical receptacle storage means of configuration to receive and store the memo cards after the date on a particular card has passed, and the step of moving the memo card from its dated day receptacle to this historical receptacle storage means after the engagement noted on the memo card has passed.

BRIEF DESCRIPTION OF THE DRAWINGS

FIG. 2 is a plan view of the three fold wallet of FIG. 1 but with the first and second panels removed therefrom;

FIG. 3 is an enlarged, somewhat schematic, fragmentary vertical sectional view taken on a major longitudinal axis of the first daily calendar panel showing one manner of constructing a plurality of adjacent pockets forming parts of the first and second panels of the invention, with the transverse thickness of the panel forming and pocket material being grossly exaggerated for clarity of illustration;

FIGS. 6 and 7 are front and back views, respectively, of one of several Sunday-indicating cards as seen in FIG. 1;

FIG. 8 is a fragmentary sectional view of a lower portion of the daily calendar panel and its supporting wallet section as seen in FIG. 1, but disclosing how it appears during the month of February;

FIG. 10 is a perspective view of a wallet made according to the first form of the invention with the sections carrying the first and second panels facing to the rear and disclosing the positioning of other wallet sections carrying a scratch or note pad, a compartment for carrying paper currency, and two compartments for carrying credit cards, business cards and the like.

DETAILED DESCRIPTION OF THE PREFERRED EMBODIMENTS

Figure 1:
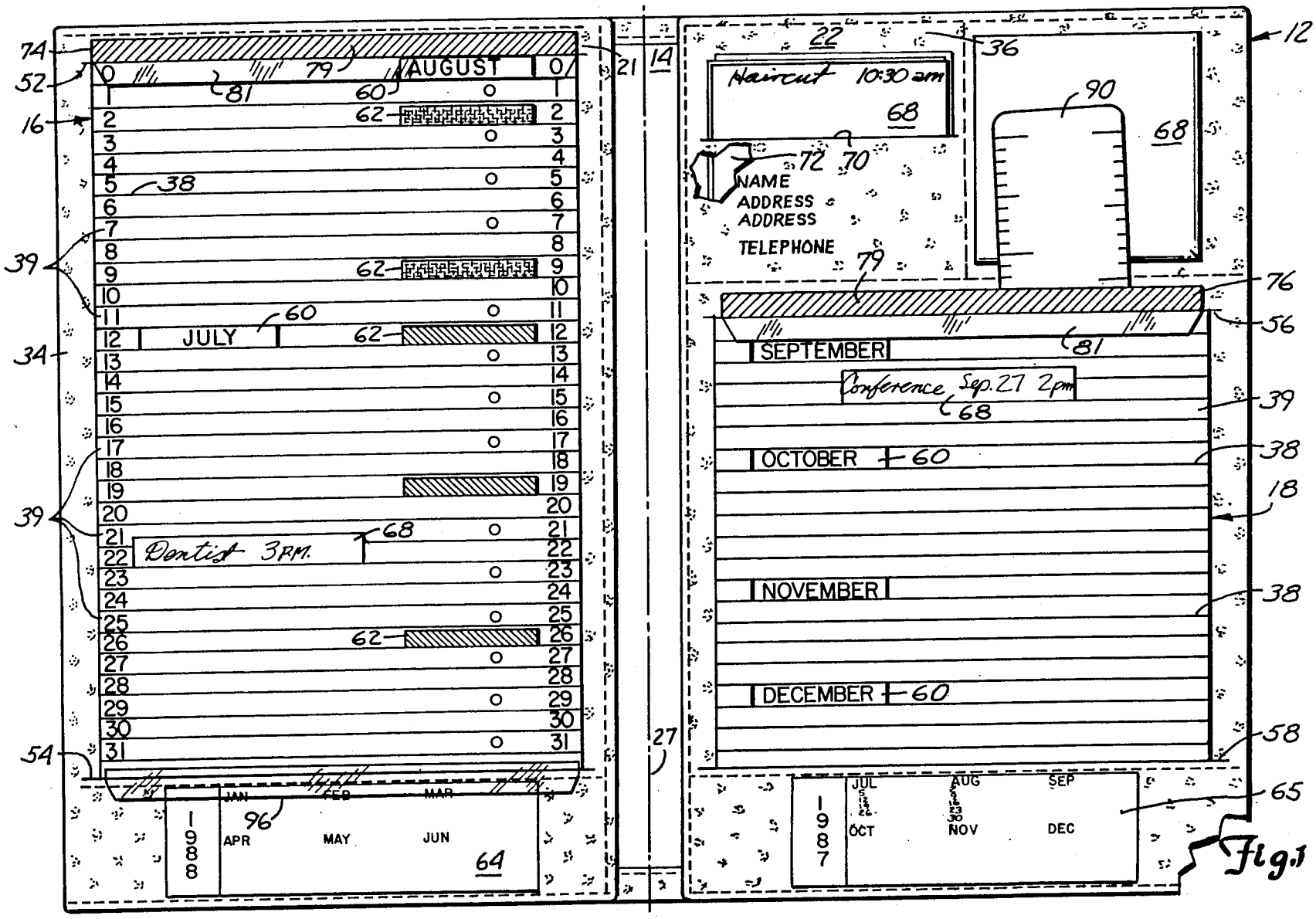
FIG. 1 is a plan view of a first daily calendar panel and a second advance engagement panel supported on two sections of a three fold, eight section perpetual engagement calendar and wallet made according to a first form of the present invention, but also illustrating a one fold, four section, perpetual engagement calendar and wallet made according to a second form of the invention.

A first form of perpetual engagement calendar and wallet 12 includes a three fold, eight section wallet case 14 which supports a daily calendar panel or first panel 16 and an advance engagement panel or second panel 18. The wallet case 14 includes an outer first section 21, an outer second section 22, and outer third and fourth sections 23 and 24, respectively, each of these third and fourth sections being joined to one of the first and second sections and each being joined to the other on one of three wallet fold lines 26, 27 and 28. The wallet case 14 also includes an inner fifth wallet section 29 back to back with first section 21, inner sixth section 30 back to back with third section 23, inner seventh section 31 back to back with fourth section 24, and inner eighth section 32 back to back with second section 22. The outer third section 23 and fourth section 24 are not shown directly but form the outer covers of the wallet case 14 when the wallet is closed on its fold lines and the first and second panels are in face to face contacting relation with each other.

In the form of the invention as shown, the outer first section 21 and the outer second section 22 of the wallet case 14 are laminated. Outer first section 21 has an outside laminate 34 and an inside laminate 35. Similarly, the outer second section 22 has an outside laminate 36 and an inside laminate 37.

The daily calendar first panel 16 includes thirty-two different pockets; and the advance engagement second panel 18 includes, in the form of the invention as shown, twenty pockets. Each of the pockets of the first and second panels is designated by the numeral 38. As best seen in FIG. 3, each of these pockets 38 is formed so as to have an upper visible top edge portion 39 and a lower portion 40 covered by a next lower pocket cover piece. Here the entire first panel 16, including all of the pockets, is seen to be made of a single strip 41 of suitable material. One end of this strip is constituted as a backing piece 42 which is contiguous at its bottom end with an outer layer 44 of the bottommost of a two layer pocket cover piece 45 of the bottom pocket 38. An inner layer 46 of this bottommost cover piece 45 is integral with and lies in contact with its outer layer 44 and defines the front wall of the bottom pocket 38. Except for this bottom pocket, an outer layer 44 of each pocket cover piece 45 also defines the back wall of the pocket 38 just below it. As seen in FIG. 3, the inner layer 46 of the uppermost pocket 38 is contiguous with an outwardly extending top piece 48 of strip 41 which is in intimate contact with an upper portion of the backing piece 42. This top piece 48 extends over the top of that backing piece to become a downwardly extending supporting portion 50.

To position the daily calendar first panel 16 in outer first wallet section 21, this downwardly extending supporting portion 50 of the panel is inserted through a first slit 52 in the outside laminate 34 of outer first section 21 and fed down into the space between that outside laminate and inside laminate 35 of that section. As this is being done, the bottom edge of the bottom pocket 38 is fed through a second slit 54 in laminate 34 to take position as seen to the left in FIG. 1.

As best seen in FIG. 2, a third slit 56 is provided in the outside laminate 36 of the outer second section 22 of the wallet case 14, and a fourth slit 58 is provided in that same laminate 36.

The advance engagement second panel 18 can be formed in the same manner as the first panel 16, and a downwardly extending supporting portion 50 of panel 18 will be slid through a slit 56 in outside laminate 36 into contact with inside laminate 37. The bottom edge of the bottom pocket 38 will be fed through a slit 58 in laminate 36 so that panel 18 will have position as seen to the right in FIG. 1.

Figure 9:
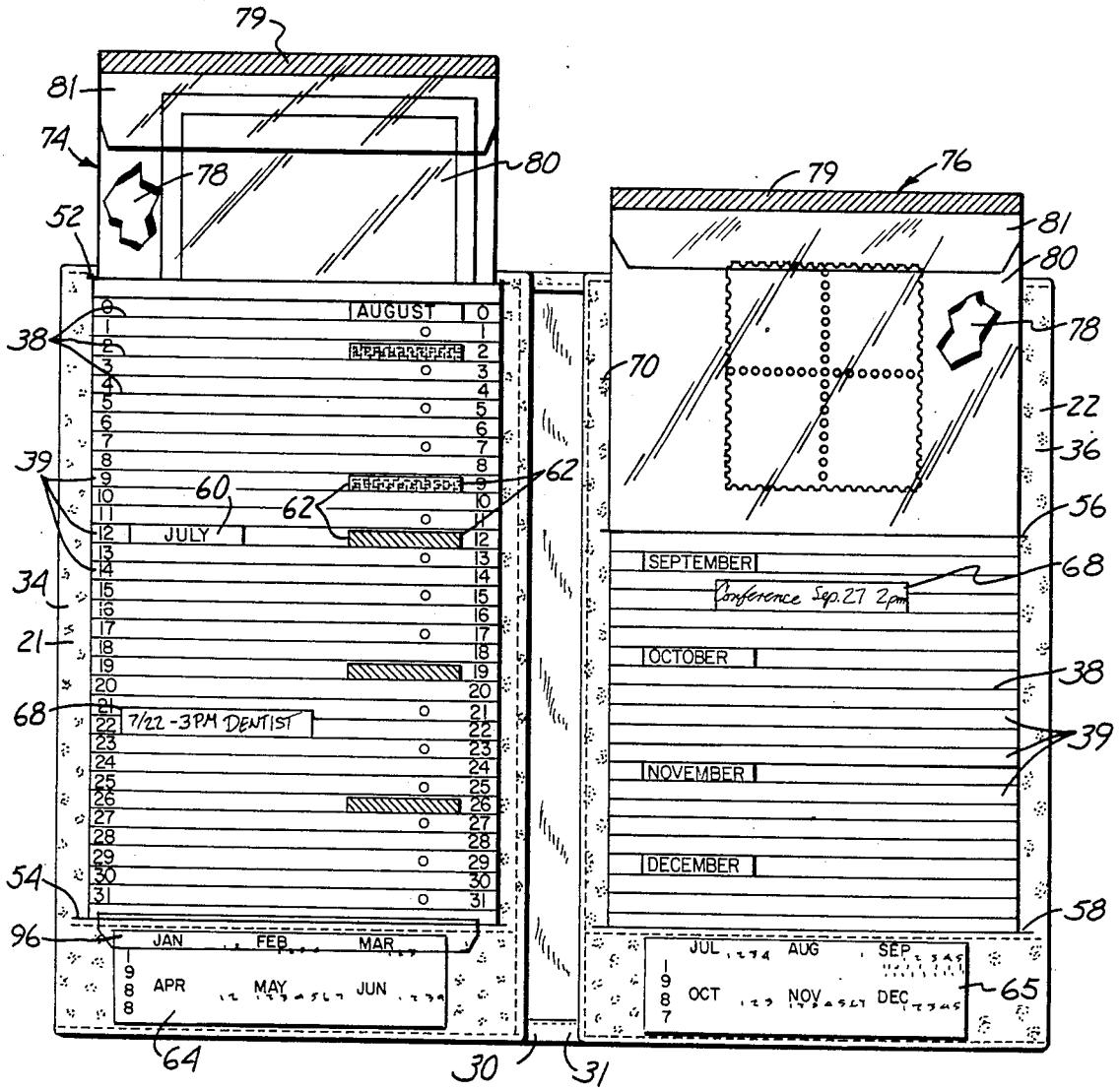
FIG. 9 is a plan view of the elements of the first form of the invention as seen in FIG. 1 on a reduced scale but indicating the positioning of wallet storage envelopes or pockets for carrying checks and postage, for example, behind the daily calendar and advance engagement panels, respectively.

As seen in FIGS. 1 and 9, upper visible top edge portions 39 of the pockets 38 in daily calendar first panel 16 are numbered consecutively from top to bottom from zero through thirty-one.

Figure 4:
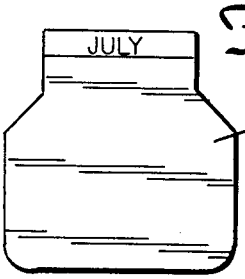
FIGS. 4 and 5 are front and back views, respectively, of one of a series of month-indicating cards as seen in FIG. 1.
Figure 5:
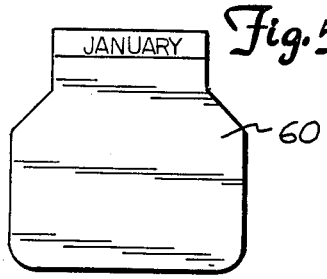

A plurality of month-indicating cards 60 form part of the perpetual engagement calendar 12. In the form of the invention herein disclosed, six cards are used, each having one month identified on one side of the card and another month identified on the other. For example, in FIG. 4, one month card 60 bears indicia identifying the month of July on one side; and the other side of the same card, as seen in FIG. 5, bears indicia identifying the month of January.

Also forming part of the perpetual engagement calendar are cards identifying a particular day of the week, called herein weekindicating cards or "Sunday cards" 62. As seen in FIG. 6, one side of a particular card 62 bears indicia of one color (yellow as shown); and as seen in FIG. 7, the other side of that same card 62 bears contrasting indicia (green as shown). At least five such cards are provided.

The perpetual engagement calendar of the invention as shown herein is set up for use on July 12, 1987. A replaceable pressure sensitive calendar sheet 64 for the first six months in 1988 is affixed to a bottom portion of the outside laminate 34 of the outer first section 21 of the wallet case 14; and a similar replaceable calendar sheet 65 covering the last six months in 1987 is affixed to a lower portion of the outside laminate 36 of the outer second section 22 of the wallet case.

Five months have less than thirty-one days. As each of these shorter months becomes current, the bottom day pocket 38 and a number blocking screen 92 is used. This blocking screen 92 includes an opaque card 94 and a transparent flap 96 extending downwardly from the top edge of the opaque card.

In use, during the month of February, for example, the blocking screen 92 will be positioned with its lowermost end portion through the second slit 54 in the laminate 34 of the outer first section 21 of the wallet case 14, and with its uppermost edge blocking the pockets 38 numbered for the twenty-ninth, thirtieth, and thirty-first days of the month. On leap year, the blocking screen 92 will be positioned one pocket lower, and in the four months which are thirty days long, only the day pocket numbered thirty-one will be covered. During the other seven months, the blocking screen 92 will be pushed down into the slit 54 so that no numbers are blocked and so that the transparent flap 96 will overlie the calendar sheet 64 without impairing the use of that sheet.

The perpetual engagement calendar and wallet 12 of the present invention, as shown, includes a plurality of mini-memo sheets, cards or pages, herein referred to as "memo cards 68". As shown, these memo cards are, until the dates and details of future engagements are written on them, attached in multicard pads to the upper right-hand corner of the outside laminate 36 of the outer second section 22 of the wallet case. After dates and details of scheduled engagements are written on a particular memo card 68, that card will be positioned in the appropriate pocket or other receptacle of one of the first and second panels as will be explained below.

As seen in FIGS. 1 and 2, a slit 70 is provided in the upper left-hand portion of the outside laminate 36 of the outer second section 22 of the wallet case 14. This slit provides access to a historical receptacle storage means or past engagement pocket 72. When the date on a particular memo card 62 is passed and/or when the engagement has been completed or cancelled, that memo card can be removed from the first panel 16 and placed through the slit 70 into the passed engagement pocket 72 if the user of the perpetual calendar wants to retain the information on it as a historical record.

Alternatively, an additional daily calendar panel such as the first panel 16 can be provided for each then current month, and the outdated memo cards 68 can be placed in pockets related to their dates to give the user a complete historical picture of all of the engagements of that month. An advantage of this arrangement is that at the time the memo card becomes outdated or at any time in the future, the user can determine whether or not information about a particular engagement is to be saved or discarded.

The construction of the outer first section 21 and outer second section 22 of the wallet case 14 makes it possible to incorporate other important features into the perpetual engagement calendar and wallet 12. First, record storage means in the form of an elongate expense record envelope 74, for example, can be stored through the slit 52 behind the daily calendar panel 16; and an asset storage means in the form of a stamp storge envelope 76, for example, can be stored through the slit 56 behind the second panel 18.

Each of these envelopes 74 and 76 consists of an opaque back sheet 78 having a colored strip 79 (brown as shown) extending along the top edge thereof, a transparent front sheet 80, and a transparent front flap 81 extending integrally downwardly from the top edge of the transparent front sheet 80. The top edge of the front sheet 80 and the transparent front flap 81 are integral with each other but are not connected to the back sheet 78 nor the colored strip 79. However, the side edges and the bottom edge of the front sheet 80 and the back sheet 78 are sealed to each other to form the record storage envelope or expense record envelope 74. Similarly, the side and bottom edges of the front sheet 80 and the back sheet 78 are sealed to each other to form the asset storage means or stamp storage envelope 76.

With the panels 16 and 18 in position as seen in FIG. 1, the bottom edges of these envelopes 74 and 76 will be inserted through the slits 52 and 56, respectively, behind the respective first and second panels 16 and 18. As these envelopes are slid into position, the bottom edge of each transparent front flap 81 will be slid down over the top upper visible top edge portions 39 of the top pockets 38 and down into these top pockets.

When it is desired to have access to one of the envelopes 74 or 76, that envelope will be grasped by the extending colored strip portion 79 and removed far enough to free the transparent front flap 81. This flap can then be used to pull the top edge of the transparent front sheet 80 away from the back sheet 78, so that items can be added to and/or withdrawn from the envelope. When this has been accomplished, the envelope is slid back into place with the front flap 81 going down into the uppermost pocket 38 to move from position as seen in FIG. 9 to the position as seen in FIG. 1.

A three fold, eight section wallet case 14 is disclosed herein, and this allows the wallet case to accommodate many if not all of the items which a person might like to include in a wallet. However, the perpetual engagement calendar feature is substantially embodied in the first outer section 21 and second outer section 22 of the wallet case 14. Therefore, a perpetual engagement calendar and wallet consisting of nothing more than the outside laminate 34 and inside laminate 35 of the outer first section 21 and the outside laminate 36 and inside laminate 37 of the outer second section 22 connected together by the inside laminates along a fold line such as fold line 27, and as disclosed in FIGS. 1 through 9, will embody many of the features of the perpetual engagement calendar.

Nevertheless, there are substantial additional advantages to constituting the calendar and wallet of the invention so as to encompass the three fold, eight section wallet case 14 as shown. Some of these features are clearly seen in FIG. 10. The inner fifth wallet section 29 and the inner eighth wallet sections 32, like the first and second sections 21 and 22, are laminated. In FIG. 10, only one laminate of each section is visible. The other laminate of each is directly behind the visible one. Among the features of the three fold, eight section wallet 14 are the three horizontal slits 84 in each of these two visible laminates of sections 29 and 32 to provide six storage spaces for business cards and/or credit cards. A money flap 86 is attached to the face of the inner sixth section 30 and a note pad or checkbook 88 is attached to the face of the inner seventh section 31 of the wallet case.

As seen in FIG. 10, neither the right-hand vertical edge of the visible laminate of the fifth section 29 of the wallet case nor the left-hand vertical edge of the visible laminate of the outer eighth section 32 of the wallet case is attached to its hidden laminates. This provides a pair of "secret" compartments where may be inserted cash or travellers checks, etc.

METHOD OF USE OF PERPETUAL ENGAGEMENT CALENDAR AND WALLET

The disclosure of this invention illustrates a perpetual engagement calendar and wallet 12 set up for use on July 12, 1987. During that month, Sundays occurred on the fifth, twelfth, nineteenth and twenty-sixth. Accordingly, week-indicating cards or Sunday cards 62 with one set of their distinctive indicia (yellow as shown) facing outward are installed to the right in the day pockets or receptacles 38 numbered twelve, nineteen and twenty-six. Month-indicating card 60 labeled JULY and JANUARY is also situated in day pocket numbered 12 with its indicia JULY facing outward. Back on the 2nd of July, the month-indicating card 60 labeled FEBRUARY and AUGUST had been placed in the top pocket of first panel 16 with the label AUGUST facing outward. In August of 1987, Sundays occurred on the second, ninth, sixteenth, twenty-third and thirtieth. As the month-indicating card 60 labeled JULY moved down from day to day, Sunday cards 62 with their green sides outward were placed in day pockets or receptacles 38 labeled two and nine. As July progresses, day cards with their green sides uppermost will be placed successively in day pockets 38 labeled sixteen, twenty-three and thirty as they become available.

By way of example, the perpetual calendar as shown indicates only three appointments or engagements. When the user got an appointment during the last week in June for a haircut at 10:30 A.M. on June 30, this engagement was noted on a memo card 68, and that memo card was placed in the day pocket or receptacle 38 of the daily calendar panel 16 numbered thirty under the month-indicating card 60 labeled JUNE. After the user kept the appointment and had the haircut, this memo card 68 was removed from the first panel 16 and inserted through slit 70 into the past engagement pocket 72.

Subsequently, the user undertook an engagement for July 22, at 3:00 P.M. with the dentist, and a memo card 68 was properly inscribed and inserted into the day pocket numbered twenty-two under the month-indicating card 60 labeled JULY. The user also undertook to attend a conference on September 27 at 2:00 P.M., noted that information on a memo card 68, and placed that card in one of the pockets under the month-indicating card 60 with the label SEPTEMBER uppermost.

Engagements scheduled for October, November or December will be recorded on memo cards 68 and placed in pockets adjacent or below the indicated months. Memo cards recording engagements scheduled on or after the twelfth of August will be stored in the top day pocket 38 labeled "0" until the day pocket currently reserved for July becomes available to the month of August. Memo cards identifying engagements scheduled for January or February of 1988 can be stored in the top pocket of the advance engagement panel 18 until the month-indicating card 60 labeled JULY is removed after the last day of July, reversed, and inserted with the label JANUARY outward in place of the month-indicating card SEPTEMBER which will replace the card 60 labeled AUGUST as that card moves down from day to day. At that point memo cards 68 indicating engagements scheduled for January will be removed from the top pocket and out in place below the notation JANUARY, leaving the engagements for February to be so placed at the end of August.

It is often helpful or required to carry a flat flexible ruler or scale about one's person. For that person, a scale 90 is shown carried behind the advance engagement panel or second panel 18 and the stamp storage envelope 76, passing through slit 56. This scale 90, however, has a second important purpose. As seen in FIG. 1, this flexible scale or rule is in position to hold the pad of memo cards 68 flat against the outside laminate 36 of the outer second section 22 of the wallet case 14. Thus these memo cards or mini-memo sheets or pages on this pad do not tend to be bent, curled or rolled upward when the stamp storage envelope 76 is raised to the position as seen in FIG. 9, for example, and replaced. When it is desired to enter information regarding the date and nature of an engagement on the uppermost card 68 of this pad of memo cards, the scale 90 is simply slid to the left in clearing relationship to that pad. Before folding the wallet case for storage, the scale 90 is replaced in the position as seen in FIG. 1.

Although the present invention has been described with reference to preferred embodiments, workers skilled in the art will recognize that changes may be made in form and detail without departing from the spirit and scope of the invention.

What is claimed is:

1. A perpetual engagement calendar for use with a calendar system which divides years into months, months into days, and weeks into days, the calendar including:

(a) a daily calendar first panel including a day pocket for at least each day in the longest month of a year, one such day pocket being visually associated with each day within a month by the presence of indicia adjacent to said day pockets, said pockets being assembled in serial relation running from the first day of the month to the last day of the month;

(b) a plurality of memo cards, each of configuration to fit within any day pocket, said cards being adapted to receive, and retain and display information identifying an engagement scheduled for a particular day in a particular month;

(c) a plurality of month indicating cards, each carrying indicia identifying a particular month and each such month card being of configuration to fit adjacent to day pocket indicia so as to display the month identifying indicia; and (d) a plurality of week-indicating cards carrying indicia for visually distinguishing a particular day of the week in one month from the same day of the week in an immediately preceding or succeeding month and each such week-indicating card being of configuration to fit adjacent to day pocket indicia so as to display said week-indicating card indicia.

2. A perpetual engagement calendar for use with a calendar system which divides years into months, months into days, and weeks into days, the calendar including:

(a) a daily calendar first panel including a day pocket for at least each day in the longest month of a year, one such day pocket being visually associated with each day within a month by the presence of indicia adjacent to said day pockets, said pockets being assembled in serial relation running from the first day of the month to the last day of the month;

(b) a plurality of memo cards, each of configuration to fit within any day pocket, said cards being adapted to receive, and retain and display information identifying an engagement scheduled for a particular day in a particular month;

(c) a plurality of month indicating cards, each carrying indicia identifying a particular month and each such month card being of configuration to fit adjacent to day pocket indicia so as to display the month identifying indicia;

(d) a plurality of week-indicating cards carrying indicia for visually distinguishing a particular day of the week in one month from the same day of the week in an immediately preceding or succeeding month and each such week-indicating card being of configuration to fit adjacent to day pocket indicia so as to display said week-indicating card indicia;

(e) an advance engagement second panel including a plurality of advance storage pockets at least some of such storage pockets being of configuration to receive one of the month-indicating cards so as to display its month identifying indicia and each such advance storage pocket being of configuration to receive one or more of the memo cards; and (f) wallet means for supporting the first panel and second panel in adjacent relation to each other.

3. The perpetual engagement calendar and wallet means of claim 2 wherein:

(g) said wallet means also provides means to store said month-indicating cards, said week-indicating cards and to store memo cards before being inscribed with data information.

4. The calendar and wallet means of claim 3 wherein:

(h) historical memo cards storage means is provided in the wallet means, this storage means being of configuration to receive and store certain dated memo cards after the day and month entered on such cards has passed.

5. The calendar and wallet means of claim 3 wherein:

(h) the wallet means includes a wallet having at least two sections, one supporting said first panel and one supporting said second panel, said wallet being so constructed as to hold said panels to move between an open condition lying in a single plane in adjacent spaced relation to each other and a closed condition in face-to-face contacting relation to each other.

6. The calendar and wallet of claim 5 wherein:

(i) said wallet includes four outside sections integrally back to back with four inside sections, each section being connected to at least one adjacent section on one of three fold lines; and (j) the first and second panels each being supported on one of the two end outside sections, the two center outside sections being constituted as outside cover sections.

7. The calendar and wallet of claim 6 wherein:

(k) the four inside sections together accommodate and provide at least one flap of configuration to hold flat flexible paper approximating the size of paper currency, at least one compartment of size and configuration to receive and temporarily store cards the size of business cards and credit cards, and means for retaining a note pad or checkbook.

8. The calendar and wallet of claim 6 wherein:

(i) at least one of the two end outside sections supporting one of the first and second panels is laminated, an outside laminate being slit at an upper portion thereof; and (j) said panel has a downwardly extending supporting portion integral with the top of the rest of the panel and extending down through the slit between the outside laminate and an inside laminate to thus support the panel on the section.

9. The calendar of claim 8 wherein:

(k) a storage envelope including a rectangular back sheet and a front sheet congruent with the back sheet, these sheets being sealed to each other at two sides and the bottom is of configuration to hold items to be stored flat and to slide down behind the supporting portion of the panel and through the slit in the outside laminate of the outside section to a storage position between said section laminates.

10. The calendar and wallet of claim 9 wherein:

(l) when the storage envelope is in its storage position, a front flap extends integrally downwardly from the top edge of the storage envelope to have position in front of a top edge portion of the panel whereby this front storage envelope flap can be grasped to manually retrieve the storage envelope from its storage position.

11. For use with a calendar system which divides years into months, months into days and weeks into days, a method for keeping track of future, present and past engagements including:

(a) providing a plurality of day receptacles, one for every day in the longest months of a year, and, using indicia, identifying each day receptacle with a different day of the longest month;

(b) providing a plurality of memo cards, each of configuration to fit within any day receptacle and each adapted to receive, retain and display, when in a day receptacle, informational indicia including the month, day and nature of a scheduled engagement;

(c) providing a plurality of month-naming cards, each carrying indicia indicating a month of the year;

(d) at the beginning of each current month, associating the month-naming card indicating the name of this current month with the day receptacle identified with the first day of said current month to thereby associate the current month name with the first and all of the remaining days of the current month;

(e) as each day passes, associating the current month-naming card with the day receptacle identified with the then current day of that month to thereby associate the current month name with the current day and with all of the remaining days of that current month;

(f) by at least the second day of the current month, associating the month-naming card indicating the name of the next coming month with the day receptacle identified with the first day of the month to thereby associate the name of the next coming month with the first day and all following days up to the then current day; and (g) entering on a separate memo card the month and day and any other identification of an engagement to be fulfilled and placing that memo card in the day receptacle associated with that month and day after such receptacle becomes associated with that month and day.

12. The method of claim 11 and the steps of:

(h) providing advance receptacle means to store at least one memo card prior to the availability of a day receptacle associated with the month and day on the memo card; and (i) storing in said advance receptacle means each dated memo card which carries a date ahead of any date associated with any day receptacle and moving each such stored memo card to a day receptacle as that day receptacle becomes associated with the month and day on such memo card.

13. The method of claim 12 and the steps of:

(j) providing historical receptacle storage means of configuration to receive and store at least one memo card after the date on that card has passed; and (k) moving said memo card from its dated day receptacle to said historical storage means after the engagement noted on the memo card has passed.

14. A perpetual engagement calendar for use with a calendar system which divides years into months, months into days, and weeks into days, the calendar including:

(a) a daily calendar first panel including a day pocket for at least each day in the longest month of a year, one such day pocket being visually associated with each day within a month by the presence of indicia adjacent to said day pockets, said pockets being assembled in serial relation running from the first day of the month to the last day of the month;

(b) a plurality of memo cards, each of configuration to fit within any day pocket, said cards being adapted to receive, and retain and display information identifying an engagement scheduled for a particular day in a particular month;

(c) a plurality of month indicating cards, each carrying indicia identifying a particular month and each such month card being of configuration to fit adjacent to day pocket indicia so as to display the month identifying indicia; and (d) means for blocking visual access to day pocket indicia identifying days which are not present when a month shorter than thirty-one days is displayed, said means consisting of an opaque card of size to fit into the bottommost day pocket and to extend above the day pocket identifying the thirty-first day.

* * * * *

UNITED STATES PATENT AND TRADEMARK OFFICE

CERTIFICATE OF CORRECTION

PATENT NO. : 4,794,711

DATED : January 3, 1989

INVENTOR(S) : Richard A. Christensen

It is certified that error appears in the above-identified patent and that said Letters Patent is hereby corrected as shown below:

Column 10, Line 6, delete "data" and insert "dated"

Signed and Sealed this

Thirtieth Day of May, 1989

*Attest:*

DONALD J. QUIGG

*Attesting Officer*

*Commissioner of Patents and Trademarks*